United States Patent [19]

Kawai et al.

[11] Patent Number: 4,496,824

[45] Date of Patent: Jan. 29, 1985

[54] METHOD FOR CONTROLLING TEMPERATURE OF HEAT GENERATING ELEMENT OF THERMAL PRINTING HEAD AND CIRCUIT FOR PRACTISING SAME

[75] Inventors: Hirokazu Kawai; Fumio Takahashi, both of Ise, Japan

[73] Assignees: Shinko Electric Co., Ltd.; Kanzaki Paper Mfg., Co., Ltd., both of Tokyo, Japan

[21] Appl. No.: 472,993

[22] Filed: Mar. 7, 1983

[30] Foreign Application Priority Data

Mar. 18, 1982 [JP] Japan ..... 57-43195

[51] Int. Cl.[3] ..... B41J 3/20

[52] U.S. Cl. ..... 219/216; 400/120; 346/76 PH

[58] Field of Search ..... 219/216 PH; 400/120; 346/76 PH; 165/58, 59, 61, 64

[56] References Cited

U.S. PATENT DOCUMENTS

| | | | |
|---|---|---|---|
| 3,840,878 | 10/1974 | Houston | 346/76 PH |
| 3,929,215 | 12/1975 | Hayakawa | 400/120 |
| 4,376,942 | 3/1983 | Toth | 346/76 PH |

FOREIGN PATENT DOCUMENTS

| | | | |
|---|---|---|---|
| 2341181 | 3/1974 | Fed. Rep. of Germany | 400/120 |
| 52-33544 | 3/1977 | Japan | 400/120 |
| 55-32608 | 3/1980 | Japan | 346/76 PH |
| 55-51574 | 4/1980 | Japan | 400/120 |
| 56-62170 | 5/1981 | Japan | 400/120 |
| 57-208274 | 12/1982 | Japan | 400/120 |

OTHER PUBLICATIONS

Nakaya, S., "New Thermal Ink-Transfer Printing", Proceedings of the SID, vol. 23/1, 1982, pp. 51-55.

*Primary Examiner*—Roy N. Envall, Jr.
*Assistant Examiner*—Teresa J. Walberg
*Attorney, Agent, or Firm*—Cushman, Darby & Cushman

[57] ABSTRACT

A method and circuit for controlling the temperature of heat generating elements of a thermal transfer type thermal printing head is presented. The temperature of the thermal printing head is compared with preset low and high temperatures, within this range a normal thermal printing is effected. When the printer head temperature is high above the high preset temperature, a blower is energized in order to air-cool the printer head surface. When the printer head temperature goes lower than the preset low temperature, then the printing head is lifted up apart from the platen and thereafter all of the heat generating elements are heated up. The latter heating operation can be carried out prior to the start of the thermal transfer operation or during the thermal transfer operation by intermittently halting the operation.

4 Claims, 3 Drawing Figures

METHOD FOR CONTROLLING TEMPERATURE OF HEAT GENERATING ELEMENT OF THERMAL PRINTING HEAD AND CIRCUIT FOR PRACTISING SAME

BACKGROUND OF THE INVENTION (a) Field of the Invention

This invention relates to a method for controlling the temperature of heat generating elements of a thermal printing head for a thermal transfer type thermal printer, and to a control circuit for controlling the temperature of heat generating elements of a thermal printing head. More particularly, this invention relates to a method and circuit for controlling the temperature of heat generating elements of a thermal printing head which is capable of eliminating adverse effects from the ambient temperature upon the thermal head and enables the obtaining of a constant density in printing qualities.

(b) Description of the Prior Art

A known thermal printer carries out a thermal printing by selectively heating up one or more of heat generating elements so as to print a desired character or symbol on a thermal printing paper. A typical conventional driving circuit for such a thermal printing head including heat generating elements is shown in FIG. 1 wherein only a main portion of the circuit is illustrated for the simplification of description. In the figure, the main circuit comprises a plurality of heat generating elements $H_1$ to $H_n$, a gate circuit 2 including the same number of NAND gates as that of the heat generating elements $H_1$ to $H_n$, and a shift register 1. The shift register 1 receives a serial printing data $P_1$ and converts it into a n-bit parallel printing data. Every digit of the n-bit parallel printing data is respectively supplied to one input terminal of the corresponding NAND gate, and a strobe pulse signal $S_1$ having a suitable pulse width for heating up the elements is applied to the other input terminal of the corresponding NAND gate. Thus, the heat generating elements $H_1$ to $H_n$, which are coupled between a voltage source $+V$ and respective output terminals of the NAND gates, are selectively heated up in accordance with the contents of the n-bit parallel data (binary logical levels 0 and 1) supplied from the shift register 1.

The amount of heat to be produced in the heat generating element is determined by the product of electric power and period during which the heat generating element is activated. The effective temperature of the heat generating element, however, is decided depending on the environmental temperature where the element is exposed. As a result, even if the same electric power and period is employed in the heat generating element, the higher the ambient temperature rises, the darker or deeper the thermal printing quality is made, and contrary to the above, the lower the ambient temperature falls, the lighter or thinner the thermal printing quality is made.

In view of the problem above, it has been proposed to mount a thermal detector, such as a thermistor or the like, at the vicinity of the heat generating elements. In accordance with the output from the thermal detector which correctly follows the change of the ambient temperature, the adjustment of the pulse width of the strobe signal $S_1$ or of the voltage value of the voltage source $+V$ is carried out so as to control the heat to be generated in the heat generating elements $H_1$ to $H_n$.

Thus, a constant printing quality is maintained regardless of the ambient temperature change.

Such a conventional method for compensating the ambient temperature change, however, is applicable only to those types of thermal printers where thermal printing is performed directly onto a thermal printing paper. This is because thermal printing papers available in the market need not require a large amount of heat to obtain allowable printing quality and have a wide operative heat range. Apart from the direct thermal printing as above, a thermal transfer printing has been widely adopted in the art wherein thermal printing is carried out indirectly by transferring heat-dissolving ink contained in a transfer film onto a printing paper. In order to obtain a good printing quality by utilizing a transfer film presently available in the market, it has been a common practise to power the heat generating element up to its maximum rating. Otherwise, sufficient heat energy could not have been produced for a good printing quality. The reason is that thermal transfer efficiency is relatively poor when compared with the direct thermal printing, whereby a substantially large amount of heat is required to obtain a good printing quality and only a narrow operative range can be permitted.

In the latter thermal transfer method, it has been found not satisfactory in that the conventional method for compensating the ambient temperature change described above can not be applied to. In other words, the operating temperature of the heat generating element is set nearly at the maximum, that is, approximately the widest possible pulse width or highest possible voltage are commonly used respectively for the strobe signal $S_1$ or the voltage source $+V$. In this situation, if the ambient temperature goes low below the anticipated one, then the heat to be produced in the heat generating element must be increased in order to compensate the ambient temperature change and to restore the previous printing quality. But, there is no room for both pulse width and source voltage to accommodate a necessary adjustment. Conversely, if the ambient temperature goes high over the anticipated one, the conventional method can be applied to compensate the ambient temperature change by either narrowing the pulse width or by decreasing the source voltage. However, in practice, it is difficult to effectively dissipate heat from the heat generating element by such a conventional method, particularly when a continuous long term printing is being performed. Thus, the temperature at the thermal printer head including the heat generating elements is unavoidably forced to rise by a gradual accumulation of heat, thereby causing a dark or blackish printing paper.

In a preferred example of the present invention which will be described hereinunder in detail, the method for controlling the temperature of heat generating elements of a thermal transfer type thermal printing head which elements are used for effecting a thermal transfer of heat-dissolving ink onto a printing paper being delivered along a platen surface, comprises the steps of: (a) comparing the temperature of said thermal printing head with first and second predetermined temperatures, said first temperature being higher than said second temperature; (b) when the temperature of said thermal printing head goes lower than said second temperature, lifting up said printing head apart from said platen and subsequently heating up said heat generating element by feeding an electric power thereto; and (c) when the temperature of said thermal printing head goes higher than said first temperature, actuating a blower to force said element to be air-cooled.

The foregoing and other objects, the features and the advantages of the present invention will be pointed out in, or apparent from, the following description of the preferred embodiments, considered together with the accompanying drawings.

DETAILED DESCRIPTION OF A PREFERRED EMBODIMENT

Figure 2:
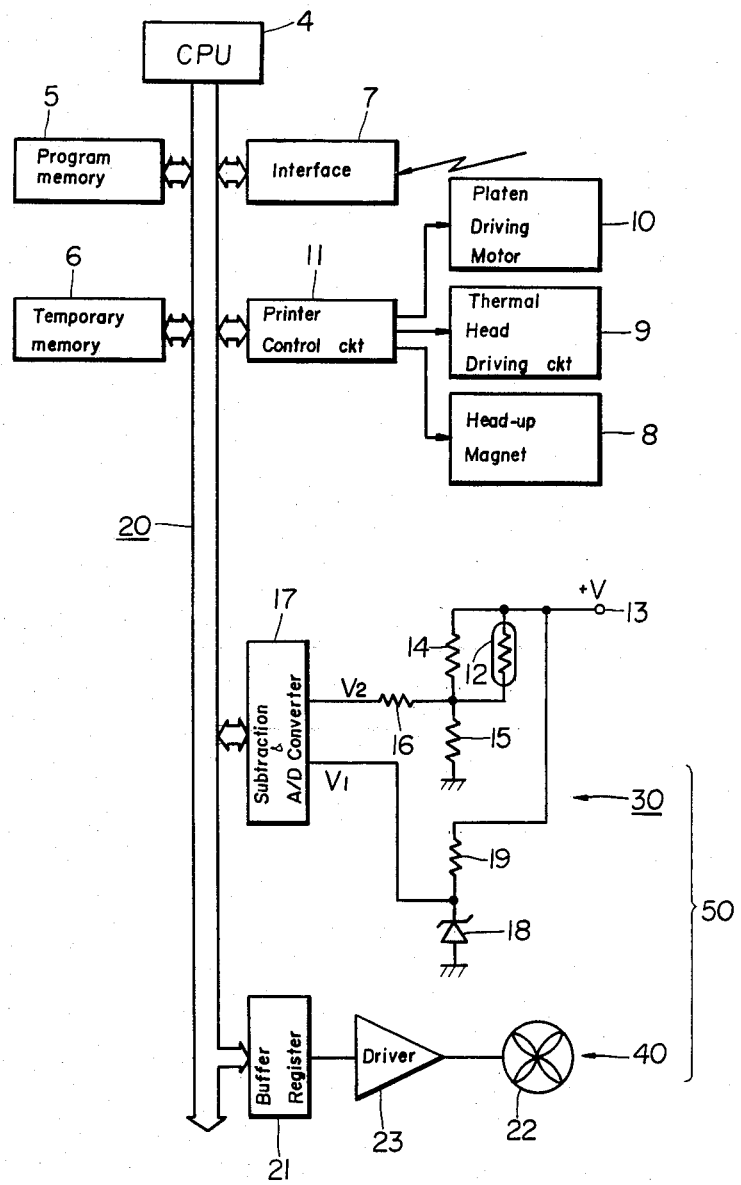
FIG. 2 is a schematic circuit diagram of a control and driving circuit for a thermal transfer type printer wherein a control circuit for a heat generating element according to the invention is incorporated.

Referring now to FIG. 2, one of the preferred embodiments of the temperature control circuit practising the method according to the invention will be described. The temperature control circuit 50 comprises a temperature detecting circuit 30 and a blower driving circuit 40. The temperature control circuit 50 is electrically connected to a thermal printer (not shown) by way of a bus, the bus 20 being a part comprising a printer driver system.

The printer driver system comprises a central processing unit 4 (hereinafter referred to as CPU where applicable), a program memory 5, a temporary memory 6, an interface 7 and a printer control circuit 11, all of them being interconnected through the bus 20. The interface 7 functions to receive a printing data transmitted from a data source (not shown) and sends it to the bus 20 under the control of CPU 4. The printer control circuit 11 delivers control signals to a head-up magnet 8 for lifting up a thermal head away from a platen of the printer, to a thermal head driving circuit 9, and to a platen driving motor 10 for feeding a printing paper along the platen. The thermal head driving circuit 9 is of a conventional type described above including heat generating elements, a gate circuit, and a shift register.

The temperature detecting circuit 30 generates a digital temperature signal having a value corresponding to a temperature of the thermal head. A thermistor 12 of the circuit 30 is mounted on the thermal head surface so that a combination of the thermistor 12 and resistors 14 and 15 produces a voltage corresponding to the temperature of the thermal head. This voltage is applied through a register 16 to a subtraction and A/D (analog to digital) converter 17 as having a value of $V_2$. A zener diode 18 and a resistor 19 produce another voltage $V_1$ which is applied to the subtraction and A/D converter 17. The voltages $V_1$ and $V_2$ are subtracted from one another, and then the analog voltage difference is converted into a digital temperature signal. Thus, the digital temperature signal indicates a temperature proportional to that of the thermal printing head.

The blower driving circuit 40 functions to send air from a blower 22 toward the thermal printing head in order to make it to be air-cooled. The blower 22 is energized by a driver 23 upon reception of a specific instruction from the CPU 4 and hence from a buffer register 21.

Figure 3:
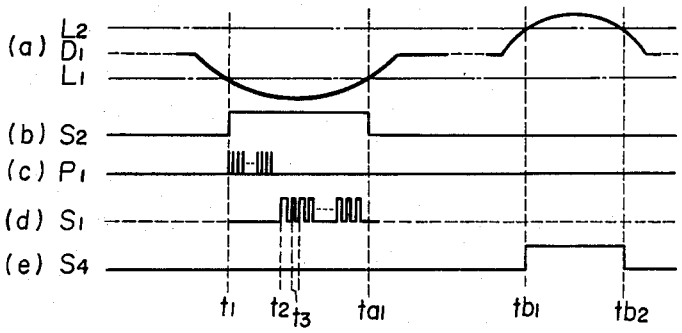
FIG. 3 is a timing chart illustrating the operation of the control circuit shown in FIG. 2.

The operation of the temperature control circuit thus constructed will be described with reference to the timing chart shown in FIG. 3. FIG. 3 shows illustratively a temperature change of the printing head at a time, and lines $L_1$ and $L_2$ show respectively preset low and high digital temperature signals.

Figure 1:
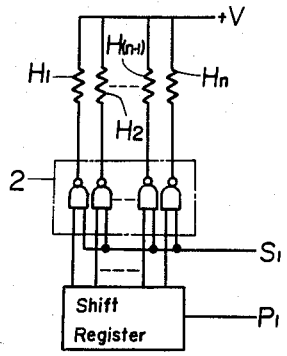
FIG. 1 is a schematic circuit diagram of a typical driving circuit for a thermal printer which may be applied to this invention.

If the digital temperature signal ($D_1$) for the printing head goes lower than the low digital temperature signal ($L_1$) at the timing $t_1$, then the CPU 4, under control of a specific program to compare the signals, detects this instant and causes the printer control circuit 11 to produce a head-up signal $S_2$ (see to FIG. 3 (*b*)). With this head-up signal $S_2$, the head-up magnet 8 is energized so that the thermal printing head is lifted up away from the platen. Concurrently with this operation, the CPU 4 also instructs the printer control circuit 11 in such a manner that the thermal head driving circuit 9 receives at its shift register (corresponding to that shown in FIG. 1) a printing data $P_1$ (see FIG. 3 (*c*)). In this case, every digit of the printing data $P_1$ has the same binary logical values, "1". The CPU 4 thereafter instructs the printer control circuit 11 in such a manner that the thermal head driving circuit 9 receives at its NAND gates (corresponding to those shown in FIG. 1) a strobe signal $S_1$ at the timings $t_2$, $t_3$, . . . (see FIG. 3 (*d*)). As a result, in a similar way to the previous description, all of the heat generating elements of the thermal head are heated. The above heating operation is repeated until the digital temperature signal ($D_1$) reaches the low temperature ($L_1$) as shown at the timing $t_{a1}$. The heating operation can be carried out either prior to the start of a thermal transfer printing or during a thermal transfer printing by intermittently halting the operation of a thermal transfer printing. In practice, the latter may be a period during which the printing paper is fed for printing a new line or a new page. During such periods while the thermal transfer printing is not performed, the above comparison of the signals ($D_1$) and ($L_1$) or ($L_2$) described later is carried out for example at about 100 msec intervals by calling a sub-routine program.

Conversely to the above, if the temperature of the thermal head rises due to the ambient temperature rise or the temperature accumulation, and whereby the digital temperature signal ($D_1$) goes higher than the high digital temperature signal ($L_2$) at the timing $t_{b1}$, then the following operation starts. The CPU 4 detects the time instant $t_{b1}$ and delivers the buffer register 21 a blower driving command. The register 21 in turn supplies the blower with a driving signal $S_4$ as shown in FIG. 3(*e*). The blower 22 then sends air to the thermal head and forcibly make it to be air-cooled, until the temperature signal ($D_1$) returns lower to the high digital temperature signal ($L_2$). The above cooling operation can be carried out during the thermal transfer operation. Thus, even the temperature rise of the thermal head due to the accumulation as well as due to the ambient temperature rise can be effectively prevented.

What is claimed is:

1. A thermal printer of the type in which heat-dissolving ink is thermally transferred onto a paper on a platen surface by heat generating elements of a print head, said thermal printer comprising:

(a) temperature detecting means for detecting the temperature of said print head to generate a heat detection signal;

(b) means for generating first and second threshold signals, said first and second threshold signals respectively representing upper and lower-limits of a desired temperature range of said print head;

(c) comparator means for comparing said heat detection signal with both of said first and second threshold signals, said comparator means generating a first control signal when said heat detection signal is greater than said first threshold signal, said comparator means generating a second control signal when said heat detection signal is less than said second threshold signal;

(d) control means responsive to said second control signal for halting normal printing operation of said thermal printer;

(e) lifting means responsive to said second control signal for lifting said print head up so that said print head is spaced from said paper;

(f) energizing means responsive to said second control signal for feeding electric power to all of said heat generating elements; and (g) cooling means responsive to said first control signal for cooling said print head.

2. A thermal printer according to claim 1, in which said cooling means is an electric blower arranged so that a flow of air produced thereby is directed to said print head.

3. A method for controlling the temperature of heat generating elements of a print head of a thermal printer in which heat-dissolving ink is thermally transferred onto a paper on a platen surface by said heat generating elements, said method comprising the steps of:

(a) detecting the temperature of said print head;

(b) subsequently comparing the detected temperature of said print head with both of upper and lower limits of a desired temperature range of said print head;

(c) when said comparing step indicates that the detected temperature of said print head is lower than the lower limit of said temperature range, subsequently halting normal printing operation of said thermal printer, subsequently lifting said print head so that said print head is spaced from said paper, and subsequently feeding electric power to all of said heat generating elements to thereby raise the temperature thereof; and (d) when said comparing step indicates that the detected temperature of said print head is higher than the upper limit of said temperature range, subsequently actuating an electric blower to cool said print head.

4. A method for controlling the temperature of heat generating elements according to claim 3, wherein said lifting and feeding steps are carried out prior to start of a normal printing operation of said thermal printer.

* * * * *